US006995329B2

(12) United States Patent
Dove et al.

(10) Patent No.: US 6,995,329 B2
(45) Date of Patent: Feb. 7, 2006

(54) SWITCH, WITH LID MOUNTED ON A THICKFILM DIELECTRIC

(75) Inventors: Lewis R. Dove, Monument, CO (US); John R. Lindsey, Colorado Springs, CO (US)

(73) Assignee: Agilent Technologies, Inc., Palo Alto, CA (US)

( * ) Notice: Subject to any disclaimer, the term of this patent is extended or adjusted under 35 U.S.C. 154(b) by 78 days.

(21) Appl. No.: 10/799,004

(22) Filed: Mar. 11, 2004

(65) Prior Publication Data

US 2005/0199479 A1 Sep. 15, 2005

(51) Int. Cl.
*H01H 29/00* (2006.01)

(52) U.S. Cl. ..... 200/182; 200/193

(58) Field of Classification Search ..... 200/182–199, 200/214–234, DIG. 43, DIG. 5
See application file for complete search history.

(56) References Cited

U.S. PATENT DOCUMENTS 6,255,730 B1 7/2001 Dove et al.
6,323,447 B1 11/2001 Kondoh et al.
6,457,979 B1 10/2002 Dove et al.
6,750,413 B1 * 6/2004 Dove et al. ..... 200/182
6,759,610 B1 * 7/2004 Dove et al. ..... 200/182
6,777,630 B1 * 8/2004 Dove et al. ..... 200/182
6,781,075 B2 * 8/2004 Dove et al. ..... 200/182

OTHER PUBLICATIONS

Marvin Glenn Wong, et al., "Formation of Signal Paths to Increase Maximum Signal–Carrying Frequency of a Fluid-Based Switch", U.S. Appl. No. 10/413,855, filed Apr. 14, 2003.
Marvin Glenn Wong, "A Piezoelectrically Actuated Liequid Metal Switch", U.S. Appl. No. 10/137,691, filed May 2, 2002.
Casey et al., "Methods for Making Microwave Circuits", U.S. Appl. No. 10/600,143, filed Jun. 19, 2003.
Casey et al., Methods for Depositing a Thickfilm Dielectric on a Substrate, U.S. Appl. No. 10/600,600, filed Jun. 19, 2003.
Lewis R. Dove, "Switch with Lid", U.S. Appl. No. (not yet assigned), 22 pages of specification including claims and abstract, eight– (8) sheets of drawings, filed Mat. 11, 2004.

* cited by examiner

*Primary Examiner*—Elvin G. Enad
*Assistant Examiner*—Lisa Klaus

(57) ABSTRACT

A switch includes a switching element, a substrate, a lid and a thickfilm dielectric. The substrate has a plurality of signal conductors formed thereon, at least some of which are in contact with the switching element. The lid covers the switching element and has a perimeter that intersects at least some of the signal conductors. The thickfilm dielectric is printed on the substrate below the perimeter of the lid, and the lid is mounted on the thickfilm dielectric.

20 Claims, 6 Drawing Sheets

SWITCH, WITH LID MOUNTED ON A THICKFILM DIELECTRIC

BACKGROUND

Fluid-based switches such as liquid metal micro switches (LIMMS) have proved to be valuable in environments where fast, clean switching is desired. However, the physical construction of a fluid-based switch sometimes limits its mission electrical performance (e.g., the frequencies at which signals propagate through the switch, or the cleanliness of signals that are output from the switch). Any development that preserves the beneficial switching characteristics of a fluid-based switch, but also increases its mission electrical performance, is therefore desirable.

SUMMARY OF THE INVENTION

One aspect of the invention is embodied in a switch. The switch comprises a switching element, a substrate, a lid and a thickfilm dielectric. The substrate has a plurality of signal conductors formed thereon, at least some of which are in contact with the switching element. The lid covers the switching element and has a perimeter that intersects at least some of the signal conductors. The thickfilm dielectric is printed on the substrate below the perimeter of the lid, and the lid is mounted on the thickfilm dielectric.

Other embodiments of the invention are also disclosed.

BRIEF DESCRIPTION OF THE DRAWINGS

Illustrative embodiments of the invention are illustrated in the drawings, in which.

DETAILED DESCRIPTION OF THE INVENTION

As indicated in the Background, supra, fluid-based switches can provide fast, clean switching. However, the physical construction a fluid-based switch often impacts its mission electrical performance (e.g., the frequencies at which signals propagate through the switch, or the cleanliness of signals that are output from the switch).

One physical aspect of a fluid-based switch that impacts the switch's mission electrical performance is the routing of its conductors. Typically, a fluid-based switch comprises first and second mated substrates that define therebetween a number of cavities holding a switching fluid. A plurality of signal conductors extend from the cavities holding the switching fluid, and other conductors extend to elements used in changing the state of the switching fluid. By routing the conductors through vias in one of the mated substrates, to external solder balls formed on one of the substrates, the conductors are "out of the way" so that the switch can be covered by a metallic enclosure. The metallic enclosure is important in that it insulates the switch and its conductors from electrical and magnetic interference and provides an environment in which electrical impedance and magnetic fields may be more closely controlled. However, by routing a switch's conductors through vias, each conductor is required to make at least a pair of right-angle turns. These turns limit the mission electrical performance of the switch. Although the turns can be eliminated by routing planar conductors to the elements of the switch, the routing of planar conductors on the surface of one of the mated substrates tends to interfere with the encapsulation of the switch in a metallic enclosure. New means for shielding switches from electrical and magnetic interference, or for other purposes, are therefore needed.

Figure 1:
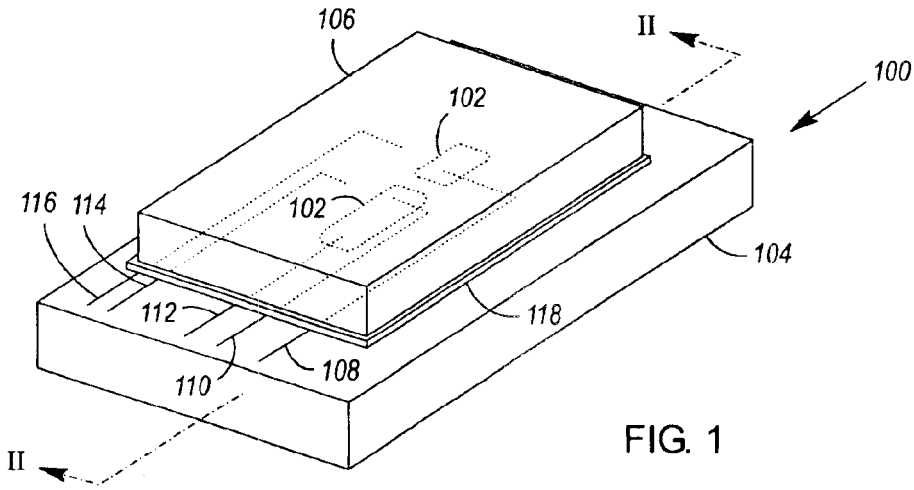
FIG. 1 illustrates a first exemplary embodiment of a switch.
Figure 2:
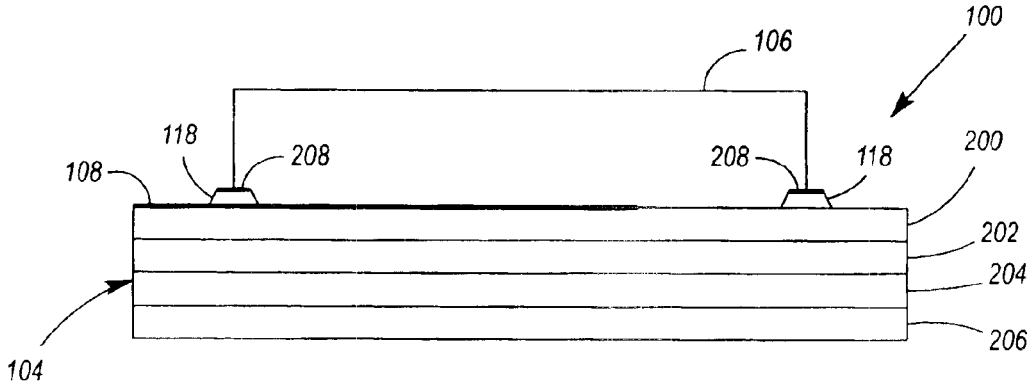
FIG. 2 illustrates a cross-section of the switch shown in FIG. 1.
Figure 3:
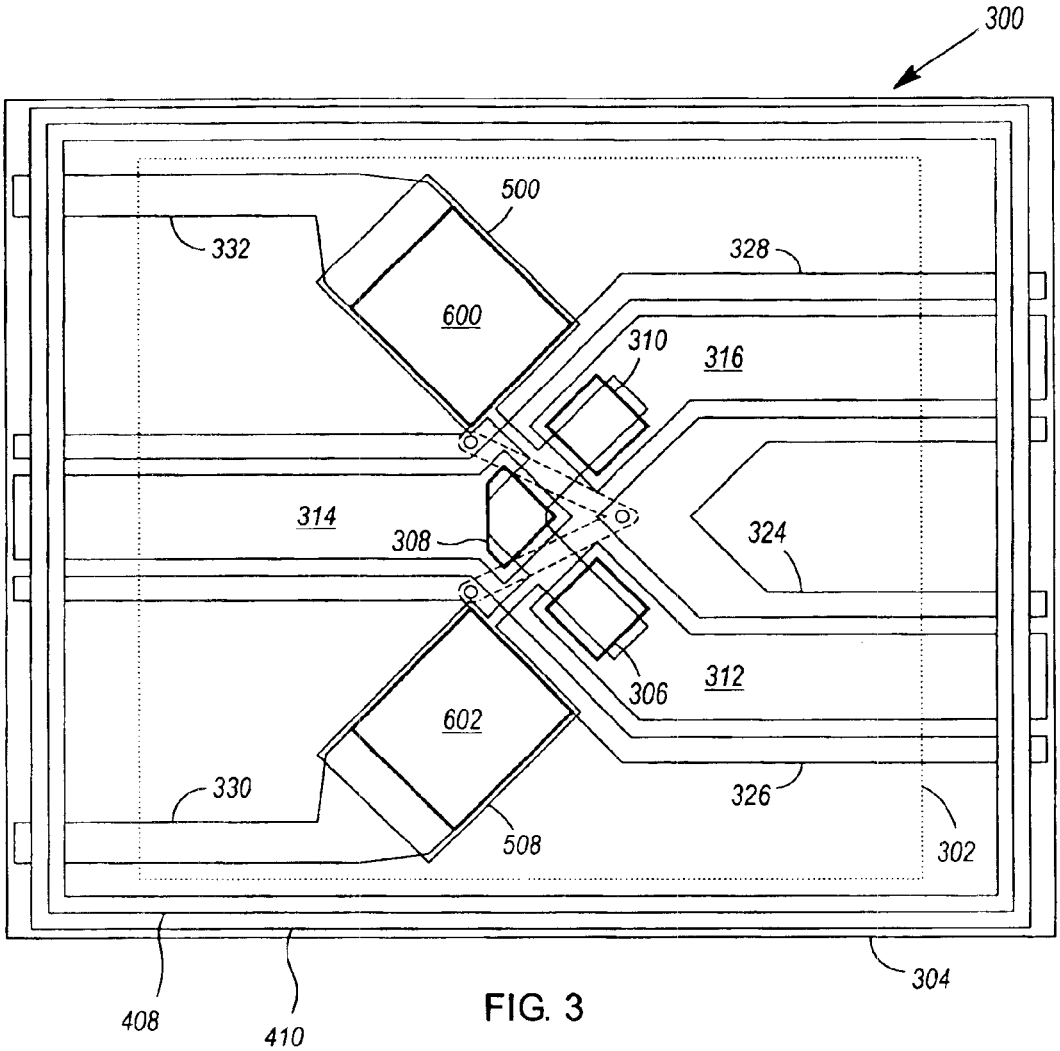
FIG. 3 is a plan view of a second exemplary embodiment of a switch.
Figure 4:
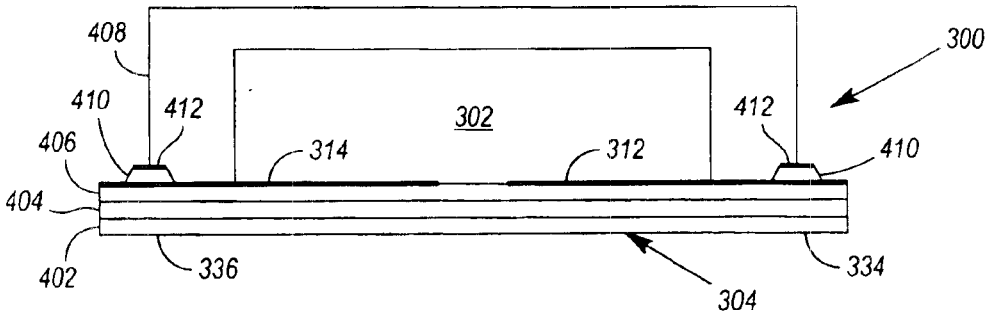
FIG. 4 illustrates a cross-section of the layers of the FIG. 3 switch.

FIG. 1 illustrates a first exemplary embodiment of a switch 100. The switch 100 comprises a switching fluid 102, a substrate 104, a lid 106, and a thickfilm dielectric 118. As shown in FIGS. 1–3, the lid 106 may serve to help contain the switching fluid 102; or, as shown in FIG. 4, a lid 408 might encapsulate another element (e.g., channel plate 302) that contains the switching fluid.

The substrate 104 has a plurality of signal conductors 108, 110, 112, 114, 116 formed thereon, at least some of which are in contact with the switching fluid 102. The lid 106 covers the switching fluid 102 and has a perimeter that intersects at least some of the signal conductors 108–116. The thickfilm dielectric 118 is printed on the substrate 104 below the perimeter of the lid 106, and the lid 106 is mounted on the thickfilm dielectric 118.

In one embodiment, the lid 106 is conductive (e.g., metallic) and is electrically coupled to a conductive thickfilm 200 printed on a top surface of the thickfilm dielectric 118 (FIG. 2). By way of example, the lid 106 may be soldered to the conductive thickfilm 200, or attached to the conductive thickfilm 200 via a conductive adhesive.

In another embodiment of switch 100, the lid 106 is made from a number of glass or ceramic layers that are bonded to one another, and the lid 106 is attached to the thickfilm dielectric 118 via an adhesive.

Although the thickfilm dielectric 118 shown in FIG. 1 forms a continuous run around the perimeter of the lid 106, it need not. Optionally, the top surface of the thickfilm dielectric 118 may be polished to control the height of the thickfilm dielectric.

The switch 100 is advantageous in that signal conductors 108–116 of the switch may be formed on a planar surface, yet still be shielded from electrical interference by the lid 408. Furthermore, and as will be explained in greater detail below, the thickfilm dielectric 118 may be chosen and applied such that the impedance of the conductors 108–116 may be carefully controlled as the conductors 108–116 pass under the lid 408. All of these factors help to improve the mission electrical performance of the switch (e.g., the frequencies at which signals propagate through the switch, or the cleanliness of signals that are output from the switch). The switch 100 is also advantageous in that the lid 408 may be bonded to the thickfilm dielectric 118 in such a manner that a hermetic seal is formed. Hermeticity keeps components of the switch (and especially the switching fluid 102) from oxidizing, thereby providing increased switch reliability and longer switch life.

Figure 5:
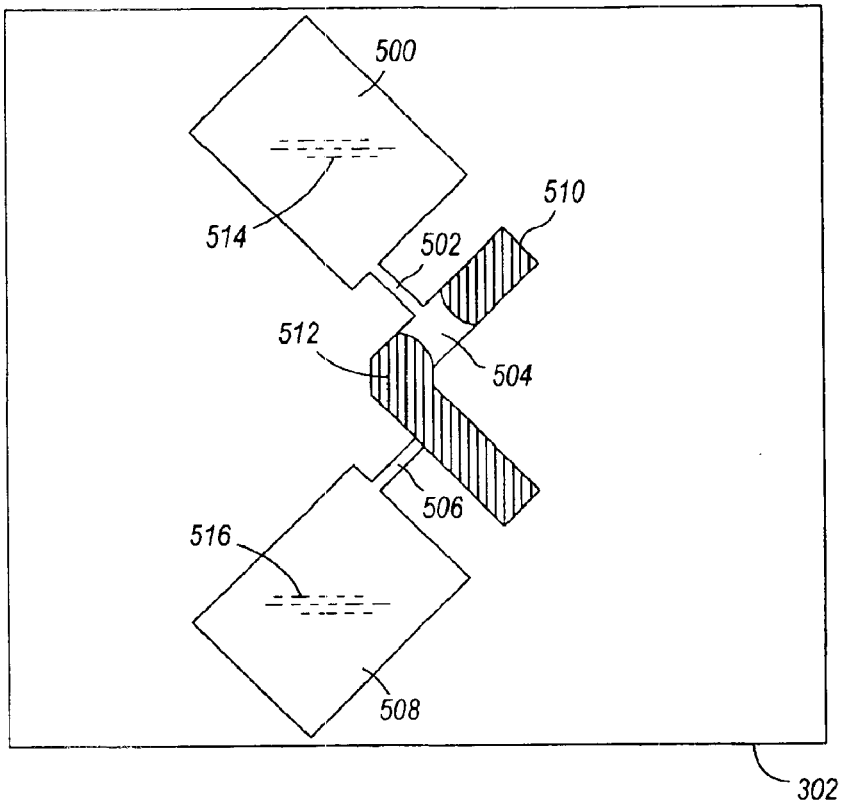
FIG. 5 is a first plan view of the channel plate of the FIG. 3 switch.

FIGS. 3–7 illustrate a second exemplary embodiment of a switch 300. The switch 300 comprises first and second mated substrates 302, 304 that define therebetween at least portions of a number of cavities 500, 502, 504, 506, 508 (FIG. 5). As shown, the substrate 302 may take the form of a channel plate, and one or more of the cavities may be at least partly defined by a switching fluid channel 510 in the channel plate 302. The remaining portions of the cavities 500–508, if any, may be defined by the substrate 304 that is mated and sealed to the channel plate 302. See FIG. 4.

The channel plate 302 and substrate 304 may be sealed to one another by means of an adhesive, gasket, screws (providing a compressive force), and/or other means. One suitable adhesive is Cytop™ (manufactured by Asahi Glass Co., Ltd. of Tokyo, Japan). Cytop™ comes with two different adhesion promoter packages, depending on the application. When a channel plate 302 has an inorganic composition, Cytop™'s inorganic adhesion promoters should be used. Similarly, when a channel plate 302 has an organic composition, Cytop™'s organic adhesion promoters should be used.

Figure 6:
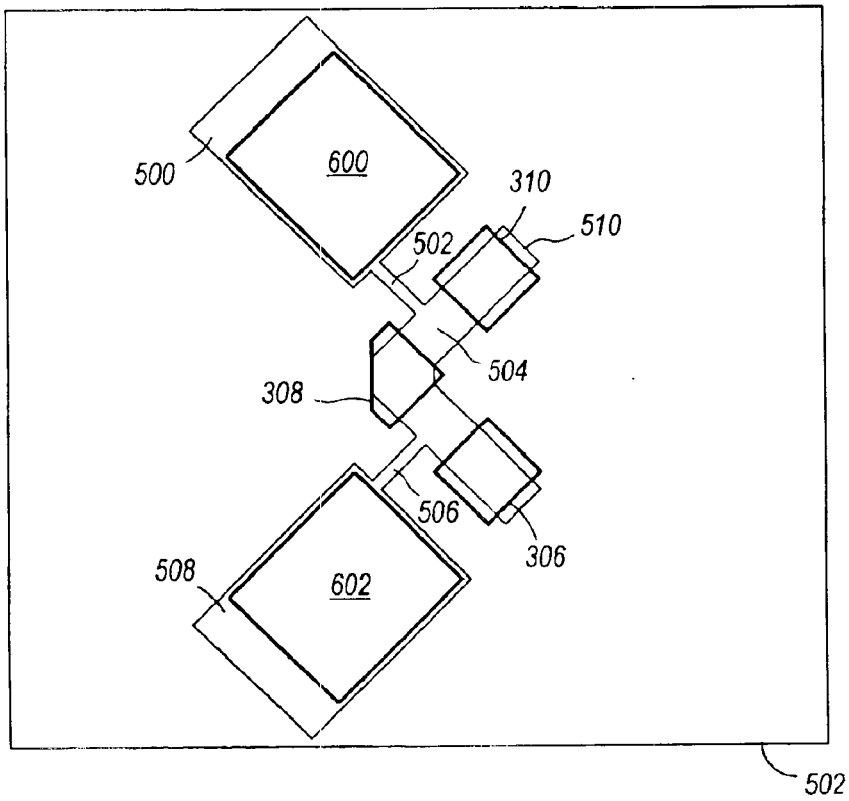
FIG. 6 is a second plan view of the channel plate of the FIG. 3 switch.

As shown in FIG. 5, a switching fluid 512 (e.g., a conductive liquid metal such as mercury) is held within the cavity 504 defined by the switching fluid channel 510. The switching fluid 512 is movable between at least first and second switch states in response to forces that are applied to the switching fluid 512. FIG. 5 illustrates the switching fluid 512 in a first state. In this first state, there is a gap in the switching fluid 512 in front of cavity 502. The gap is formed as a result of forces that are applied to the switching fluid 512 by means of an actuating fluid 514 (e.g., an inert gas or liquid) held in cavity 500. In this first state, the switching fluid 512 wets to and bridges contact pads 306 and 308 (FIGS. 3 & 6). The switching fluid 512 may be placed in a second state by decreasing the forces applied to it by means of actuating fluid 514, and increasing the forces applied to it by means of actuating fluid 516. In this second state, a gap is formed in the switching fluid 512 in front of cavity 506, and the gap shown in FIG. 5 is closed. Also in this second state, the switching fluid 512 wets to and bridges contact pads 308 and 310 (FIGS. 3 & 6).

Figure 7:
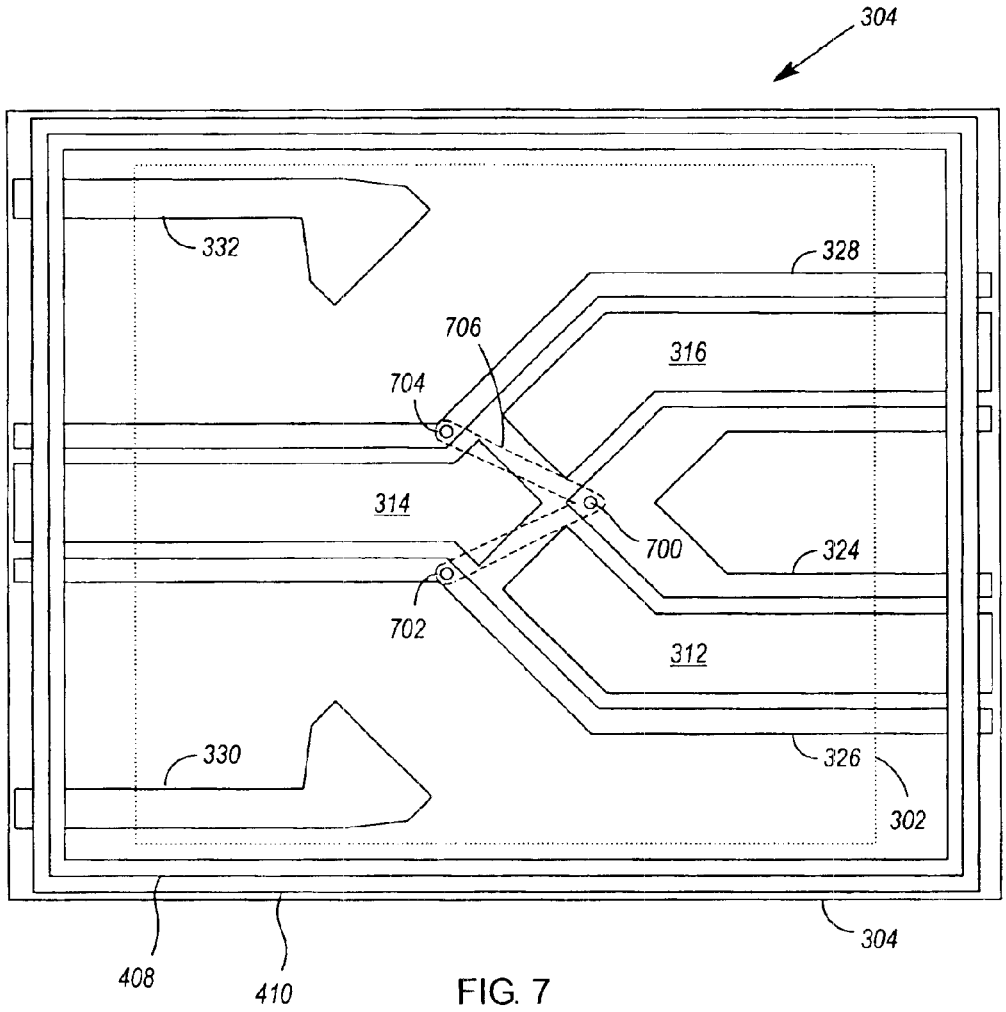
FIG. 7 is a plan view of the substrate of the FIG. 3 switch.

As shown in FIGS. 3 & 7, a plurality of signal conductors 312, 314, 316 is formed on the substrate 304. Each of the signal conductors 312–316 extends from the one or more cavities 504 holding the switching fluid 512. When the switch 300 is assembled, these conductors 312–316 are in wetted contact with the switching fluid 512. The ends 306–310 of the signal conductors 312–316 to which the switching fluid 512 wets may be plated (e.g., with Gold or Copper), but need not be.

As shown in FIG. 4, a lid 408 is attached to the substrate 304. Preferably, the lid 408 is conductive (e.g., metallic). The lid 408 covers at least a portion of the channel plate 302, and has a perimeter that intersects at least some of the signal conductors 312–316. A thickfilm dielectric 410 is printed on the substrate 304 below the perimeter of the lid 408, and the lid 408 is mounted on the thickfilm dielectric 410. By way of example, the thickfilm dielectric 410 may be a glass dielectric such as a KQ dielectric. KQ dielectrics are manufactured by Heraeus Cermalloy (24 Union Hill Road, West Conshohocken, Pa., USA), and one such dielectric is KQ CL-90-7858 dielectric. The thickfilm dielectric 410 may be variously printed, as taught in U.S. Pat. No. 6,255,730 of Dove, et al. entitled "Integrated Low Cost Thick Film RF Module", and the United States patent applications of Casey, et al. entitled "Methods for Making Microwave Circuits" (Ser. No. 10/600,143 filed Jun. 19, 2003), and "Methods for Depositing a Thickfilm Dielectric on a Substrate" (Ser. No. 10/600,600 filed Jun. 19, 2003), all of which are hereby incorporated by reference. In one embodiment of the switch 300, the thickfilm dielectric 410 is continuous about the perimeter of the lid 408.

To control the height of the thickfilm dielectric 410, the top surface of the dielectric may be polished.

A conductive thickfilm 412 may be printed on a top surface of the thickfilm dielectric 410, and the lid 408 may be electrically coupled to the conductive thickfilm 412 (e.g., via solder or conductive adhesive). By way of example, the conductive thickfilm 412 may be formed of DuPont QG150 gold (available from DuPont (1007 Market Street, Wilmington, Del., USA)).

To further facilitate high speed propagation through the switch 300, a number of planar ground conductors 324, 326, 328 may be formed adjacent either side of each planar signal conductor 312–316 (FIGS. 3 & 7). The planar signal and ground conductors 312–316, 324–328 form a coplanar transmission-line structure for signal routing, and 1) provide better impedance matching, and 2) reduce signal radiation at higher frequencies. In one embodiment, the planar ground conductors 324–328 are electrically coupled to the lid 408 by means of solder or conductive adhesive.

As shown in FIGS. 3 & 7, a single ground conductor may bound the sides of more than one of the signal conductors 312–316 (e.g., ground conductor 324 bounds sides of signal conductors 312 and 316). Furthermore, the ground conductors 324–328 may be coupled to one another within the switch 300 for the purpose of achieving a uniform and more consistent ground. If the substrate 304 comprises alternating metal and insulating layers 402–406 (FIG. 4), then the ground conductors 324–328 may be formed in a first metal layer 406, and may be coupled to a V-shaped trace 706 in a second metal layer 402 by means of a number of conductive vias 700, 702, 704 formed in an insulating layer 404.

In the prior description, it was disclosed that switching fluid 512 could be moved from one state to another by forces applied to it by an actuating fluid 514, 516 held in cavities 500, 508. However, it has yet to be disclosed how the actuating fluid 514, 516 is caused to exert a force (or forces) on switching fluid 512. One way to cause an actuating fluid (e.g., actuating fluid 514) to exert a force is to heat the actuating fluid 514 by means of a heater resistor 600 that is exposed within the cavity 500 that holds the actuating fluid 514. As the actuating fluid 514 is heated, it tends to expand, thereby exerting a force against switching fluid 512. In a similar fashion, actuating fluid 516 can be heated by means of a heater resistor 602. Thus, by alternately heating actuating fluid 514 or actuating fluid 516, alternate forces can be applied to the switching fluid 512, causing it to assume one of two different switching states. Additional details on how to actuate a fluid-based switch by means of heater resistors are described in U.S. Pat. No. 6,323,447 of Kondoh et al. entitled "Electrical Contact Breaker Switch, Integrated Electrical Contact Breaker Switch, and Electrical Contact Switching Method", which is hereby incorporated by reference.

Figure 8:
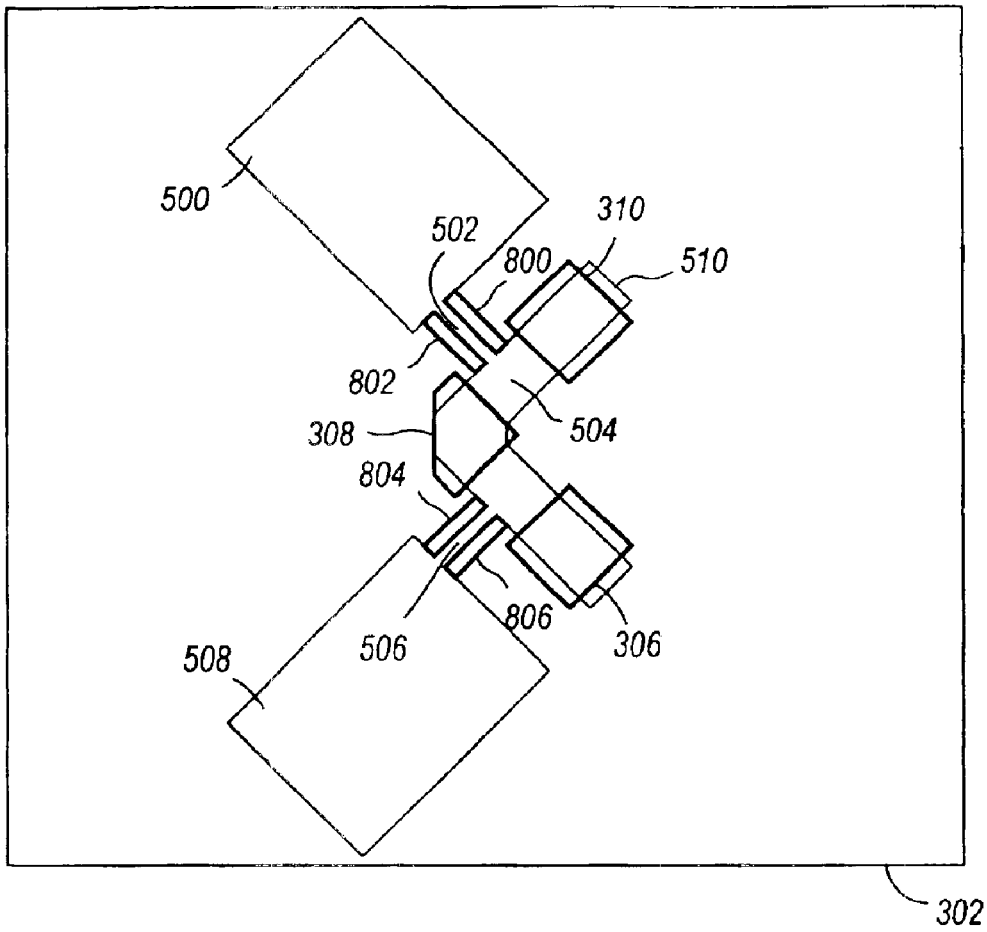
FIGS. 8 & 9 illustrate alternate embodiments of the switch shown in FIG. 3.

Another way to cause an actuating fluid 514 to exert a force is to decrease the size of the cavities 500, 502 that hold the actuating fluid 514. FIG. 8 therefore illustrates an alternative embodiment of the switch 300, wherein heater resistors 600, 602 are replaced with a number of piezoelectric elements 800, 802, 804, 806 that deflect into cavities 302, 306 when voltages are applied to them. If voltages are alternately applied to the piezoelectric elements 800, 802 exposed within cavity 502, and the piezoelectric elements 804, 806 exposed within cavity 506, alternate forces can be applied to the switching fluid 512, causing it to assume one of two different switching states. Additional details on how to actuate a fluid-based switch by means of piezoelectric pumping are described in U.S. patent application Ser. No. 10/137,691 of Marvin Glenn Wong filed May 2, 2002 and entitled "A Piezoelectrically Actuated Liquid Metal Switch", which is hereby incorporated by reference.

Although the above referenced patent and patent application disclose the movement of a switching fluid by means of dual push/pull actuating fluid cavities, a single push/pull actuating fluid cavity might suffice if significant enough push/pull pressure changes could be imparted to a switching fluid from such a cavity.

To enable faster cycling of the afore-mentioned heater resistors 600, 602 or piezoelectric elements 800–806, each may be coupled between a pair of planar conductors 330/326, 332/328. As shown in FIG. 3, some of these planar conductors may include the planar ground conductors 326, 328 that run adjacent to the planar signal conductors 312–316.

Figure 9:
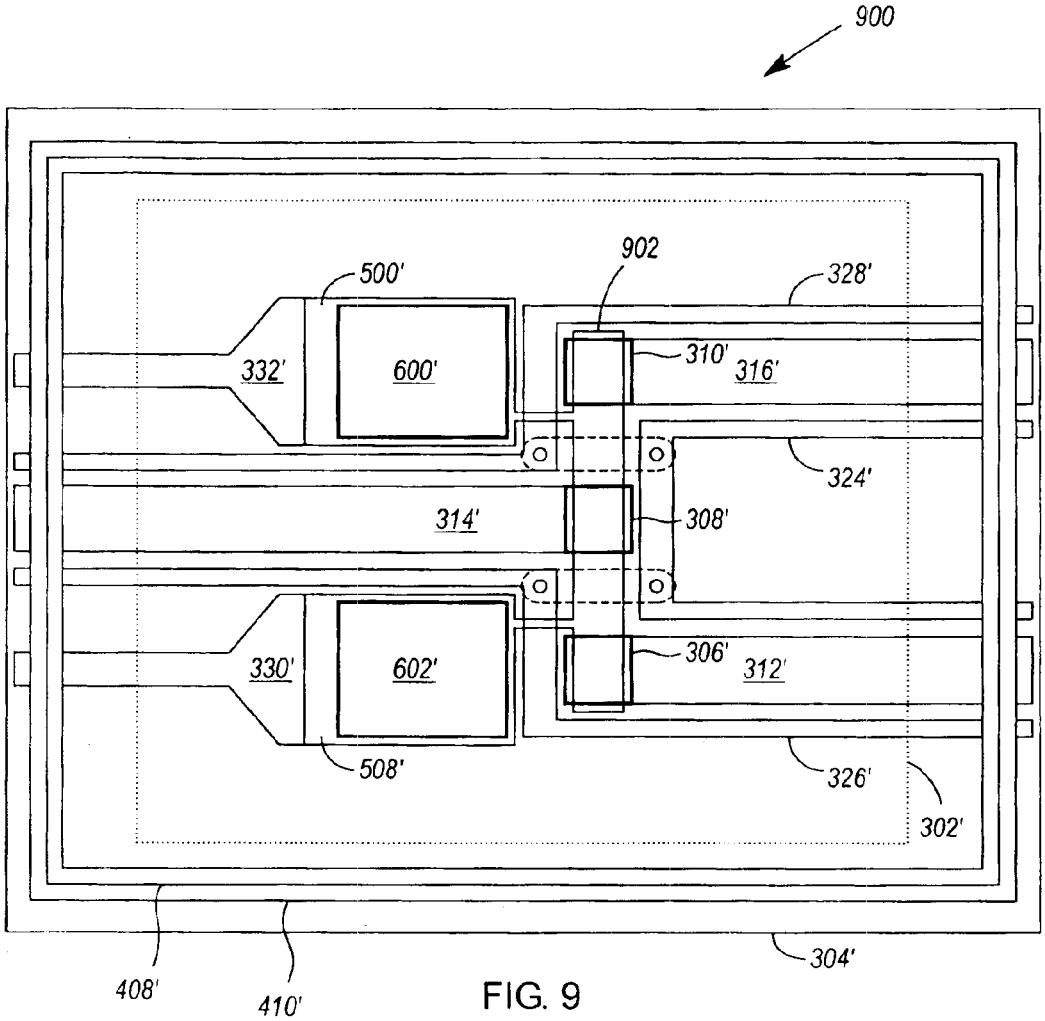

Although the switching fluid channel 510 shown in FIGS. 3, 5 & 6 comprises a bend, the channel need not. A switch 900 comprising a straight switching channel 902 is shown in FIG. 9 (other elements shown in FIG. 9 correspond to elements shown in FIG. 3, and are referenced by the prime (') of the reference numbers used in FIG. 3—i.e., 302'–332', 500', 508', 600' & 602'). If a bent switching fluid channel 510 is used, one planar signal conductor 314 may present within the cavity 510 defined by the switching fluid channel 510 "at" the bend, and additional ones of the planar signal conductors 312, 316 may present within the cavity 510 "on either side of" the bend. An advantage provided by the bent switching fluid channel 510 is that signals propagating over the switching fluid 512 held therein need not take right angle turns.

To make it easier to couple signal routes to the switch 300, it may be desirable to group signal inputs on one side of the switch, and group signal outputs on another side of the switch. If this is done, it is preferable to limit the tightest corner taken by a path of any of the planar signal conductors to less than 90°, or more preferably to about 45°, and even more preferably to less than 45° (i.e., to reduce the number of signal reflections at conductor corners).

Although the above description has been presented in the context of the switches 100, 300, 900 shown and described herein, application of the inventive concepts is not limited to the fluid-based switches shown herein, and may be applied to other fluid-based switches, or even non-fluid-based switches (e.g., switches having spring-biased metal strips, magnetic-biased metal strips or optical components as their switching elements).

While illustrative and presently preferred embodiments of the invention have been described in detail herein, it is to be understood that the inventive concepts may be otherwise variously embodied and employed, and that the appended claims are intended to be construed to include such variations, except as limited by the prior art.

What is claimed is:

1. A switch, comprising:

a) a switching fluid;

b) a substrate having a plurality of signal conductors formed thereon, at least some of which are in contact with the switching fluid;

c) a lid, covering the switching fluid and having a perimeter that intersects at least some of the signal conductors; and d) a thickfilm dielectric printed on the substrate below the perimeter of the lid; wherein the lid is mounted on the thickfilm dielectric.

2. The switch of claim 1, further comprising a conductive thickfilm printed on a top surface of the thickfilm dielectric, wherein the lid is electrically coupled to the conductive thickfilm.

3. The switch of claim 2, wherein the lid is soldered to the conductive thickfilm.

4. The switch of claim 2, wherein the lid is attached to the conductive thickfilm via a conductive adhesive.

5. The switch of claim 2, wherein the thickfilm dielectric is continuous about the perimeter of the lid.

6. The switch of claim 1, wherein a top surface of the thickfilm dielectric is polished.

7. The switch of claim 1, wherein the lid is conductive.

8. The switch of claim 1, wherein the lid is metallic.

9. A switch, comprising:

a) first and second mated substrates defining therebetween at least portions of a number of cavities;

b) a switching fluid, held within one or more of the cavities, that is movable between at least first and second switch states in response to forces that are applied to the switching fluid;

c) a plurality of signal conductors formed on the first substrate, extending from the one or more cavities holding the switching fluid;

d) a lid, attached to the first substrate and covering at least a portion of the second substrate; the lid having a perimeter that intersects at least some of the signal conductors; and e) a thickfilm dielectric printed on the substrate below the perimeter of the lid; wherein the lid is mounted on the thickfilm dielectric.

10. The switch of claim 9, wherein:

a) the second substrate is a channel plate; and b) the one or more cavities holding the switching fluid are at least partly defined by a bent switching fluid channel in the channel plate.

11. The switch of claim 10, wherein:

a) one of the signal conductors presents within the cavity defined by the bent switching fluid channel, at the bend; and b) different ones of the signal conductors present within the cavity defined by the bent switching fluid channel, on either side of the bend.

12. The switch of claim 9, further comprising a conductive thickfilm printed on a top surface of the thickfilm dielectric, wherein the lid is electrically coupled to the conductive thickfilm.

13. The switch of claim 12, wherein the lid is soldered to the conductive thickfilm.

14. The switch of claim 12, wherein the lid is attached to the conductive thickfilm via a conductive adhesive.

15. The switch of claim 12, wherein the thickfilm dielectric is continuous about the perimeter of the lid.

16. The switch of claim 9, wherein a top surface of the thickfilm dielectric is polished.

17. The switch of claim 9, wherein the lid is conductive.

18. The switch of claim 9, wherein the lid is metallic.

19. A switch, comprising:

a) a switching element;

b) a substrate having a plurality of signal conductors formed thereon, at least some of which are in contact with said switching element;

c) a lid, covering the switching element and having a perimeter that intersects at least some of the signal conductors; and d) a thickfilm dielectric printed on the substrate below the perimeter of the lid; wherein the lid is mounted on and heremetically sealed to the substrate via the thickfilm dielectric.

20. The switch of claim 19, further comprising a conductive adhesive between said lid and said thickfilm dielectric.

* * * * *

UNITED STATES PATENT AND TRADEMARK OFFICE

CERTIFICATE OF CORRECTION

PATENT NO. : 6,995,329 B2
APPLICATION NO. : 10/799004
DATED : February 7, 2006
INVENTOR(S) : Dove et al.

It is certified that error appears in the above-identified patent and that said Letters Patent is hereby corrected as shown below:

On the title page, item (56), under "Other Publications", in column 2, line 15, after "drawings," insert - - Attorney Docket No. 10020704-1, - -.

On the title page, item (56), under "Other Publications", in column 2, line 15, delete "Mat." and insert - - Mar. - -, therefor.

Signed and Sealed this

First Day of August, 2006

JON W. DUDAS
*Director of the United States Patent and Trademark Office*